United States Patent [19]

Perkins

[11] Patent Number: 4,679,626

[45] Date of Patent: Jul. 14, 1987

[54] ENERGY EFFICIENT PROCESS FOR VISCOUS OIL RECOVERY

[75] Inventor: Thomas K. Perkins, Dallas, Tex.

[73] Assignee: Atlantic Richfield Company, Los Angeles, Calif.

[21] Appl. No.: 839,459

[22] Filed: Mar. 11, 1986

Related U.S. Application Data

[63] Continuation of Ser. No. 560,696, Dec. 12, 1983, abandoned.

[51] Int. Cl.[4] ..... E21B 43/24

[52] U.S. Cl. ..... 166/248; 166/272; 166/303; 166/65.1

[58] Field of Search ..... 166/245, 248, 272, 266, 166/303; 60/648

[56] References Cited

U.S. PATENT DOCUMENTS

| | | | |
|---|---|---|---|
| 3,918,521 | 11/1975 | Snavely, Jr. et al. | 166/272 |
| 3,931,856 | 1/1976 | Barnes | 166/245 |
| 3,946,809 | 3/1976 | Hagedorn | 166/248 |
| 3,948,319 | 4/1976 | Pritchett | 166/245 |
| 3,958,636 | 5/1976 | Perkins | 166/248 |
| 4,007,786 | 2/1977 | Schlinger | 166/272 |
| 4,010,799 | 3/1977 | Kern et al. | 166/248 |
| 4,037,655 | 7/1977 | Carpenter | 166/245 |
| 4,043,393 | 8/1977 | Fisher et al. | 166/248 |
| 4,084,637 | 4/1978 | Todd | 166/248 |
| 4,285,401 | 8/1981 | Erickson | 166/65 R |
| 4,301,865 | 11/1981 | Kasevich et al. | 166/248 |
| 4,344,483 | 8/1982 | Fisher et al. | 166/248 |

*Primary Examiner*—Stephen J. Novosad
*Assistant Examiner*—Bruce M. Kisliuk
*Attorney, Agent, or Firm*—M. David Folzenlogen; Michael E. Martin

[57] ABSTRACT

A process for viscous oil recovery from a subsurface formation wherein the electric power is generated by burning combustible material and the electric power is passed through the formation via electrodes, preferably producing wells, to apply heat to the oil and reduce its viscosity. Simultaneously therewith, the hot flue gas is used to heat water which is injected into the formation to apply heat to the formation, or reduce loss of the heat created by the electric current, or to force oil toward the producing wells, or any combination thereof.

3 Claims, 3 Drawing Figures

ENERGY EFFICIENT PROCESS FOR VISCOUS OIL RECOVERY

This application is a continuation of Application Ser. No. 560,696, filed Dec. 12, 1983 now abandoned.

BACKGROUND OF THE INVENTION

This invention relates to an energy efficient process to produce viscous oil from a subsurface formation. More specifically, electricity produced by burning combustible material and hot water produced by heat exchange with the hot flue gases are combined to heat and pressurize the formation in an energy efficient manner.

Large deposits of viscous hydrocarbonaceous substances are known to exist in subterranean formations such as for example, the Ugnu formation in Alaska. Many techniques have been proposed for producing oil from formations containing viscous oils. One such proposal uses steam to heat and force oil out of the formation; but steam at the pressure levels of interest requires steam temperatures of about 500 to 600° F. For the most part, calculations indicate that the major portion of the benefit obtained from heating a formation will be achieved at temperatures of between 150° and 200° F. Steam temperatures of 500° to 600° F., therefore, use heat inefficiently.

It also has been proposed, for example, in U.S. Pat. Nos. 3,642,066; 3,874,450; 3,848,671, 3,948,319; 3,958,636; 4,010,799 and 4,084,637, to use electrical current to add heat to a subsurface pay zone containing tar sands or viscous oil to render the viscous hydrocarbons more flowable. Two electrodes are connected to an electrical power source and are positioned at spaced apart points in contact with the earth. Currents up to 1200 amperes are passed between the electrodes. Electrical heating processes seem to be consistent with temperatures of between 150° and 200° F., but power efficiency of electrical generation is only about one third. When the power is generated by burning a combustible material, e.g. methane or oil produced in the area of the viscous oil formation, in essence the combustible fuel is traded for electrical power which is then traded for viscous oil.

It is the primary object of this invention to provide a more energy efficient viscous oil recovery process operating within the optimum temperature beneficial range.

SUMMARY OF THE INVENTION

In the energy efficient process of this invention, electricity is produced by burning a combustible material. The generated electric power is used to heat subsurface viscous oil. This stimulates the producing wells and increases oil mobility between wells. Heat from the exhaust flue gas is utilized to heat water for injection into the formation. The injectivity index of the hot water injection well is high because of the combined effect of hot water and electrical power dissipation. The injected hot water replaces the reservoir volume voided by oil production, maintains a high oil driving pressure, and gives adequate unit displacement of the heated oil. Since most of the fuel energy is utilized by the combined process steps, the ratio of fuel needed for this combined electrical-hot water process versus steam flood (neglecting losses) is calculated to be of the order of 0.22.

DETAILED DESCRIPTION OF PREFERRED EMBODIMENTS

The process of the present invention is adaptable to be practiced in any formation containing viscous oils whose viscosity is susceptible to significant reduction at temperatures of between 110° and 200° F. at which the mobility of the oil is greatly increased. The maximum benefits of the process apply to formations wherein the oil has an API gravity of less than 20.

Figure 1:
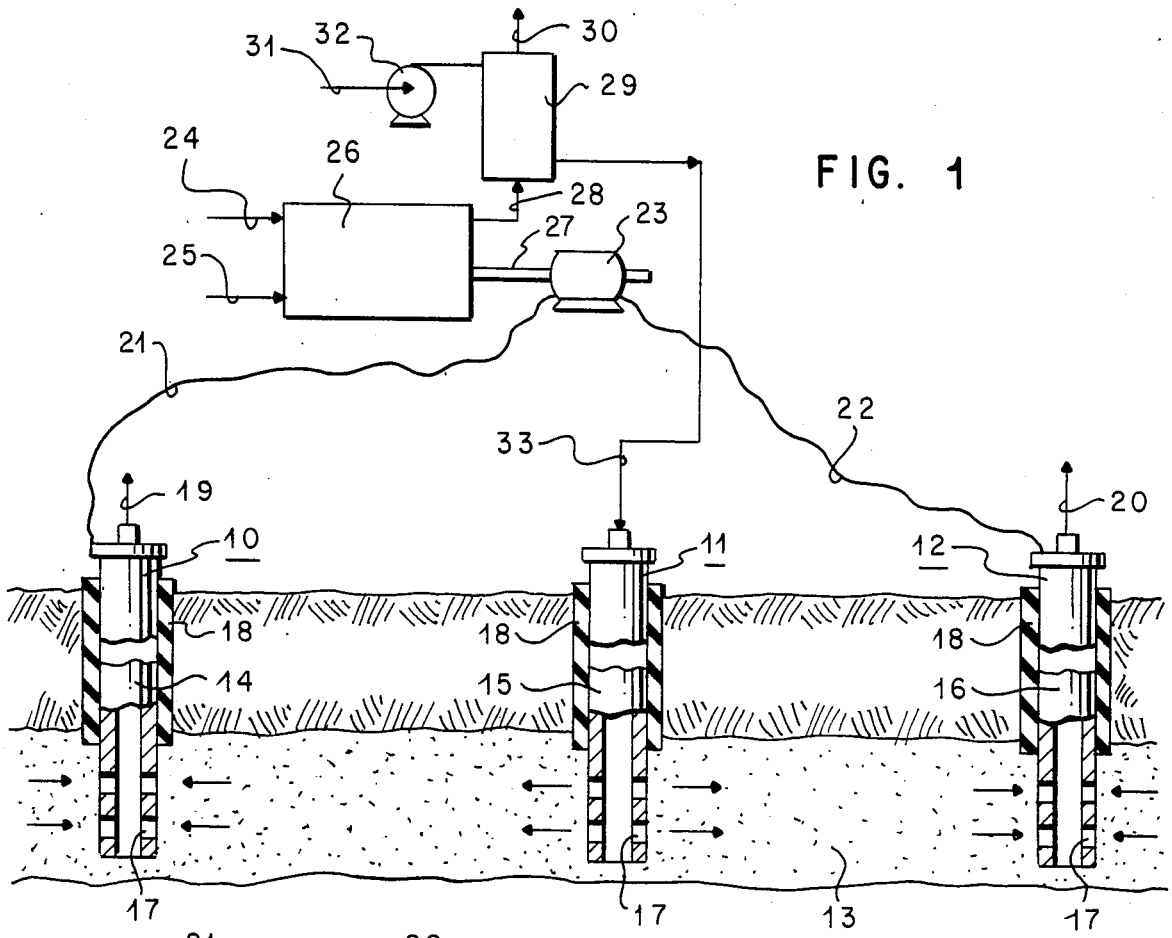
FIG. 1 is a side elevational view, partly schematic and partly in section, of one system for generating electrical power and heating injection water and utilizing the electric power and hot water in a subsurface formation.

In FIG. 1, there are illustrated three wells 10, 11 and 12 extending downward from the surface into well boreholes drilled into oil bearing formation 13. The wells may be completed in any manner suitable for the purposes herein stated, for example, in the manners set forth in co-pending applications Ser. No. 509,839, filed June 30, 1983, entitled "Well Completion for Electrical Power Transmission", and owned by a common assignee. The wells may be completed for in1ection, or production, or for switching between the two. For illustration purposes, each well is shown only with casing strings 14, 15 and 16, respectively. The casing strings are perforated with perforations 17 into the formation. The well casings are shown electrically insulated from the overburden above formation 13 by insulation 18 to reduce undesirable power losses to the overburden. Wells 10 and 12 are illustrated as producing wells through which the formation fluids are flowed, lifted or pumped to the surface exiting the wells through production flowlines 19 and 20, respectively. The produced fluids may be separated and treated in the usual fashion (not shown). Any water produced from the formation may be used as injection water for well 11. Well 11 is shown as an injection well through which heated water is injected into formation 13.

Production wells 10 and 12 are connected via conductors 21 and 22, respectively, to electrical power generator 23. In operation, electrical current will be used to heat all or a part of formation 13. Frequently, in electrical well heating, most of the energy is dissipated near the electrode. It is, therefore, preferred that the production wells be used as electrode wells because during oil production the greatest pressure drop occurs at the wellbore. The producing well, therefore, is the part of the formation where most is to be gained by heating oil in the formation. As the oil is produced, the heat moves toward the casing perforations by convection. The well tubing or casing of each electrode well may act as the electrode or, if desired, separate electrodes may be lowered into the electrode wells. The electric current may be passed from the surface through conductor wires or through the tubing or casing itself.

Power generator 23 may produce DC, pulsating DC, or single or poly-phase eccentric or regular AC of any suitable number of cycles per second. Poly-phase eccentric or regular alternating current is much preferred for its greater efficiency. Switches and voltage control means (not illustrated) may be used to control application, duration and magnitude of the voltage or current flowed between electrodes and passed through the formation. For purposes of this invention, the power generator must be operated directly or indirectly by burning a combustible fuel material. Any type of combustible material may be burned, but the fuel will generally be some material readily available in the producing area, for example, methane, heavy oil or coal. Typically, electric power is generated in three ways that produce hot exhaust flue gases.

In FIG. 1, fuel from line 24 is mixed with air in intake 25 and burned or combusted in engine or turbine 26. The turbine drives shaft 27 and turns generator 23. Hot exhaust flue gas in line 28 is passed from the turbine through heat exchanger 29 and is vented or used for other purposes through vent line 30. Water in line 31 is pumped through optional pump 32 through heat exchanger 29. Hot water leaving heat exchanger 29 is passed via line 33 into injection well 11 at a suitable pressure to displace oil in formation 13 toward producing wells 10 and 12.

Figure 2:
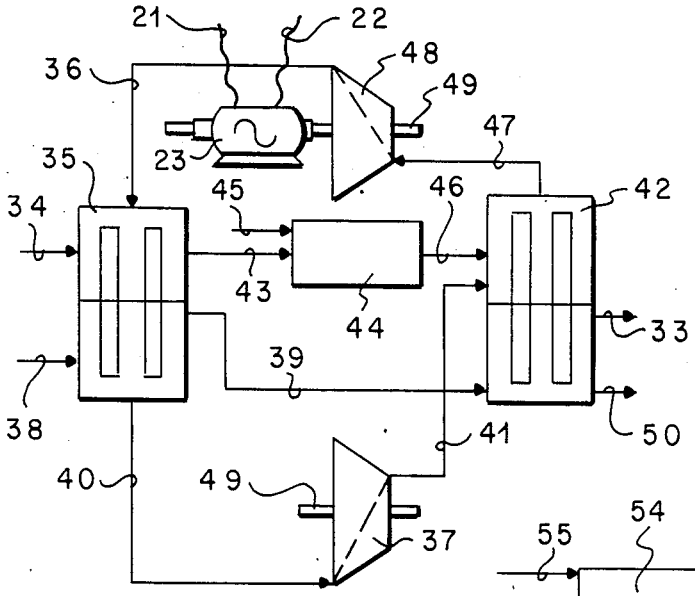
FIG. 2 is a schematical view of an alternate way of combusting fuel to generate electricity and produce hot injection water.

An alternate method of generating electricity and producing hot injection water is shown in FIG. 2 where air is passed through inlet line 34 through optional heat exchanger 35 in heat exchange with still hot turbine gas entering the exchanger through line 36. Heat exhanger 35 protects compressor 37 and is illustrated as being divided into two sections. Water enters one section of the exchanger through water inlet line 38 where it is partially heated by the heated turbine gas and exits the exchanger via line 39. After passing through both sections of heat exchanger 35, the turbine gas exits the exchanger via line 40 and is passed or flowed to compressor 37 where it is compressed to a suitable elevated pressure. The high pressure gas is flowed through line 41 into hot flue gas heat exchanger 42. As shown, heated air exits heat exchanger 35 through line 43 and flows into combustion chamber 44. Combustible material in fuel line 45 is flowed into the combustion chamber where the combustible material is burned with the air. Hot exhaust flue gases exit the combustion chamber through line 46 and the hot flue gas is flowed into hot flue gas heat exchanger 42. The hot flue gas heats the compressed high pressure turbine gas. The hot high pressure turbine gas exits the heat exchanger via line 47 and is expanded in turbine 48. The expanded turbine gas is recycled through optional heat exchanger 35. Expansion of the hot turbine gas in turbine 48 causes the turbine to spin, driving shaft 49 which rotates generator 23 generating electricity for heating formation 13. Compressor 37 is shown separated from shaft 49 so that the flow of gases and water may be more easily followed. In most instances, the compressor will also be driven by shaft 49, but the compressor may be driven by any conventional drive means. Water in line 39 flows countercurrently to the hot flue gas through a section flue gas heat exchanger 42 where it is heated to a suitable injection temperature and exits the exchanger via water injection line 33. The cooled exhaust flue gas exits the exchanger through line 50. Hot water in line 33 is pumped or flowed into injection well 11 at a suitable pressure to displace oil in formation 13 toward producing wells 10 and 12.

Figure 3:
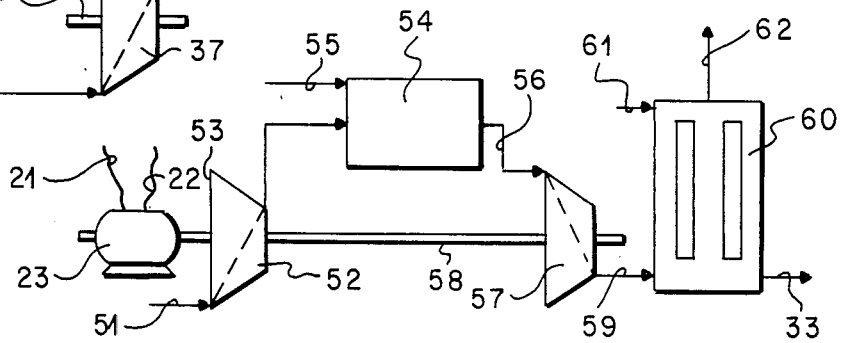
FIG. 3 is a schematical view of still another way of combusting fuel to generate electricity and produce hot injection water.

A third method of generating electricity and producing hot injection water is shown in FIG. 3 where air is passed through inlet line 51 to compressor 52 where it is compressed to a suitable high pressure and exits the compressor through line 53. The compressed air is passed to combustion chamber 54 where it is mixed and burned with fuel entering the combustion chamber through fuel inlet line 55. The hot high pressure flue gas is passed through line 56 to turbine 57 where it is expanded through the turbine and causes the turbine to spin and drive shaft 58. Shaft 58 drives compressor 52 and generator 23, thereby generating electricity for illustrative conductors 21 and 22. The hot expanded flue gas from the turbine is passed from the turbine through line 59 into heat exchanger 60. In heat exchanger 60, the hot flue gas is used to heat water entering the heat exchanger through line 61. The flue gas exits the heat exchanger through line 62 and is either vented or used for other purposes, for example, formation pressurization. Hot water exits heat exchanger 60 through line 33 where it is pumped or flowed into injection well 11 at a suitable pressure to displace oil in formation 13 toward producing wells 10 and 12.

In operation, the producing area is prepared for the process of this invention. If desirable, the producing zone may be preheated with electricity, steam or other form of heat or cold or hot water may be injected to pressurize the formation. Sometimes there is insufficient pressure differential between the formation and the producing wellbore. External energy, for example, water or flue gas injection, may be added. Preparation of the producing area will include selection of the desired number of wells and well patterns. This selection will partially depend on the type and number of phases of the electrical power to be applied. For example, direct current may be used in some parts of the formation while alternating current is applied in other parts. By way of further example, a six phase configuration, with or without neutral voltage may be employed in conjunction with a hexagonal well pattern.

When the producing area is prepared, voltage and current will be generated in conventional manner by burning combustible material. Electrical voltages varying from a few hundred volts to 1000 or more will be applied to the electrode production and injection wells and currents from few hundred to 1000 or more amperes will be flowed between the electrodes. Most of the power will flow through the formation between the electrodes. Since there will be a high current density adjacent the electrode producing wells, the temperature will tend to increase more rapidly near the wells. Simultaneously, while the electric current is being flowed, hot exhaust flue gases from an electric generation system, e.g., methane driven engine, gas turbine systems or any other type of electric generating system producing sufficient hot exhaust flue gas, will be used to heat water to an appropriate temperature designed to produce temperatures of up to 200° F. (preferably 150° to 200° F.) in the formation. The hot water will be injected into the formation at a pressure suitable to confine the electrically heated oil and maintain sufficient pressure to force oil toward the producing wells. This helps eliminate vaporization of formation fluids at the producing wellbore and causes the electrically provided heat to move by convection near the producing wells. The net result is more efficient use of energies produced at the surface.

From the foregoing, it can be seen that this disclosure achieves the purposes previously mentioned and that this invention is suitable for use in many prior art systems. Although this invention has been described with a certain degree of particularity, it is understood that the present disclosure has been made only by way of example and that numerous changes in the details of construction and the combination and arrangement of parts may be resorted to without departing from the spirit and the scope of this invention.

I claim:

1. A method of producing viscous hydrocarbons from a subterranean formation in which plural spaced apart wellbores have been drilled, said method comprising:

providing means for burning a combustible material to generate hot gases and for using said hot gases to continuously generate electrical power and to continuously heat a well injection liquid, said means including first and second heat exchangers each having means providing separate flow paths for combustion air, working gas and injection liquid, a gas compressor and a gas expander operably connected for operation with a working gas, said gas expander being drivingly connected to generator means and responsive to working gas being expanded through said gas expander for generating said electrical power;

providing electrode means in at least two of said wellbores;

simultaneously generating electrical power and heating said injection liquid by passing combustion air, working gas and injection liquid through said first heat exchanger to heat said combustion air and said injection liquid, burning said combustible material with said combustion air, passing said injection liquid, working gas and heated flue gas produced from said burning through said second heat exchanger to heat said working gas and said injection liquid;

using said electrical power to cause electrical current to pass between said electrode means in a manner such that said viscous hydrocarbons are heated; and simultaneously, while heating said viscous hydrocarbons with said current, injecting heated injection liquid into said formation through one of said wellbores to cause said viscous hydrocarbons to flow through said formation to one of said at least two wellbores.

2. A method of producing viscous hydrocarbons from a subterranean formation comprising:

drilling plural wellbores into said formation including at least two spaced apart wellbores for receiving electrode means and a third wellbore for receiving injection liquid;

providing means for burning a combustible material to generate hot gases and for using said hot gases to continuously generate electrical power and to continuously heat a well injection liquid including first and second heat exchangers each having means providing separate flow paths for combustion air, working gas and injection liquid, a gas compressor and a gas expander operably connected for operation with a working gas, said gas expander being drivingly connected to generator means for generating said electrical power;

providing electrode means in said at least two spaced apart wellbores;

simultaneously generating electrical power and heating said injection liquid by passing combustion air, working gas and injection liquid through said first heat exchanger to heat said combustion air and said injection liquid, burning said combustible material with said combustion air, passing said injection liquid, said working gas and heated flue gas produced from said burning through said second heat exchanger to heat said working gas for expansion in said gas expander and to heat said injection liquid;

using said electrical power to cause electrical current to pass between said electrode means in a manner such that said viscous hydrocarbons are heated, and simultaneously, while heating said viscous hydrocarbons with said current, injecting heated injection liquid into said formation through said third wellbore to cause said viscous hydrocarbons to flow through said formation to said at least two spaced apart wellbores.

3. The method set forth in claim 2 wherein:

said injection liquid is water, and said water is heated to a temperature sufficient to provide, combined with electrical heating of said formation, temperatures in said formation in the range of from 110° F. to 200° F.

* * * * *